US010856666B1

(12) United States Patent
Adams

(10) Patent No.: US 10,856,666 B1
(45) Date of Patent: Dec. 8, 2020

(54) TREASURE CHEST BED HOUSING APPARATUS

(71) Applicant: Samanatha Adams, Milton, FL (US)

(72) Inventor: Samanatha Adams, Milton, FL (US)

( * ) Notice: Subject to any disclaimer, the term of this patent is extended or adjusted under 35 U.S.C. 154(b) by 85 days.

(21) Appl. No.: 16/419,943

(22) Filed: May 22, 2019

(51) Int. Cl.

| | |
|---|---|
| ***A47C 19/02*** | (2006.01) |
| ***A47C 21/08*** | (2006.01) |
| ***A47D 7/00*** | (2006.01) |
| ***A47C 17/86*** | (2006.01) |
| ***A47C 21/04*** | (2006.01) |

(52) U.S. Cl.
CPC ..... *A47C 19/021* (2013.01); *A47C 17/86* (2013.01); *A47C 21/044* (2013.01); *A47C 21/08* (2013.01); *A47D 7/007* (2013.01)

(58) Field of Classification Search
CPC ..... A47C 19/021; A47C 21/044; A47C 21/08; A47C 17/74; A47C 17/86; A47D 7/00; A47D 7/007
See application file for complete search history.

(56) References Cited

U.S. PATENT DOCUMENTS

| | | | | | |
|---|---|---|---|---|---|
| 1,336,240 | A * | 4/1920 | Knight | A47D 7/007 | 5/2.1 |
| 2,787,007 | A * | 4/1957 | Erdkamp | A47D 5/00 | 5/2.1 |
| 3,011,180 | A | 12/1961 | Majeski | | |
| 3,266,063 | A | 8/1966 | Shapiro | | |
| 3,389,410 | A * | 6/1968 | Weigel | A47C 17/86 | 5/308 |
| 3,808,607 | A | 5/1974 | Harder | | |
| 3,878,570 | A * | 4/1975 | Donnelly | A47D 15/00 | 5/97 |
| D249,403 | S * | 9/1978 | Lamb | A47D 7/00 | 5/2.1 |
| 5,067,183 | A * | 11/1991 | Urquiola | A47D 7/01 | 5/2.1 |
| 5,184,360 | A * | 2/1993 | Gonzalez | A47D 11/005 | 5/2.1 |
| 5,950,257 | A | 9/1999 | Smith | | |
| 6,675,408 | B1 * | 1/2004 | Mason | A47D 7/00 | 5/2.1 |
| 7,137,881 | B2 * | 11/2006 | Walling | A47C 31/002 | 454/251 |
| 7,546,648 | B2 * | 6/2009 | Steffes | A47D 7/002 | 5/400 |
| 7,673,353 | B1 | 3/2010 | Khodabandeh | | |
| 7,971,290 | B2 | 7/2011 | Woodhams | | |
| 8,943,624 | B1 | 2/2015 | Youngstrom | | |

(Continued)

*Primary Examiner* — David R Hare

(57) ABSTRACT

A treasure chest bed housing apparatus for creating a decorative and functional bed housing includes a base having an access aperture extending through a base back side to a base interior. A top structure is coupled to the base and a door track is coupled to a foot side and a head side of the top structure and beneath a cover side. A principal door is slidably coupled within the door track to move between a closed position extending from the base adjacent the front section of the top structure and an alternate open position overlapping with the cover side of the top structure. The base, the top structure, and the principal door in the closed position resemble a treasure chest. A bed is coupled to the base and is disposed on the base top side within the top interior. An HVAC unit is coupled within the base interior.

16 Claims, 9 Drawing Sheets

(56) References Cited

U.S. PATENT DOCUMENTS

| | | | | |
|---|---|---|---|---|
| 9,044,101 | B2 * | 6/2015 | Garcia | A47C 21/048 |
| D791,494 | S | 7/2017 | Bosch | |
| 2018/0160819 | A1 * | 6/2018 | Rutledge | A47C 21/003 |

* cited by examiner

TREASURE CHEST BED HOUSING APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to bed frames and more particularly pertains to a new bed frame for creating a decorative and functional bed housing.

BRIEF SUMMARY OF THE INVENTION

An embodiment of the disclosure meets the needs presented above by generally comprising a base having a base front side separated from a base back side, a base left side separated from a base right side, and a base top side defining a base interior. The base back side has an access aperture extending through to the base interior. An access door is coupled to the base and is selectively engageable with the access aperture to close and alternatively open the access aperture. A top structure is coupled to the base, and comprises a foot side, a head side, and a cover side extending coplanarly from the base left side, the base right side, and the base back side, respectively. The foot side and the head side have a vertical back section, a vertical front section, and a pitched section extending therebetween. The base back side extends through the back section and the pitched section and defines a top interior. A door track is coupled to the foot side and the head side proximal an outer edge and beneath the cover side. A principal door is slidably coupled within the door track to move between a closed position extending from the base adjacent the front section of the top structure and an alternate open position overlapping with the cover side of the top structure. The base, the top structure, and the principal door in the closed position resemble a treasure chest. A bed is coupled to the base and is disposed on the base top side within the top interior. An HVAC unit is coupled within the base interior. A control switch is coupled to the top structure and is in operational communication with the HVAC unit. A battery is coupled within the base interior and is in operational communication with the HVAC unit.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
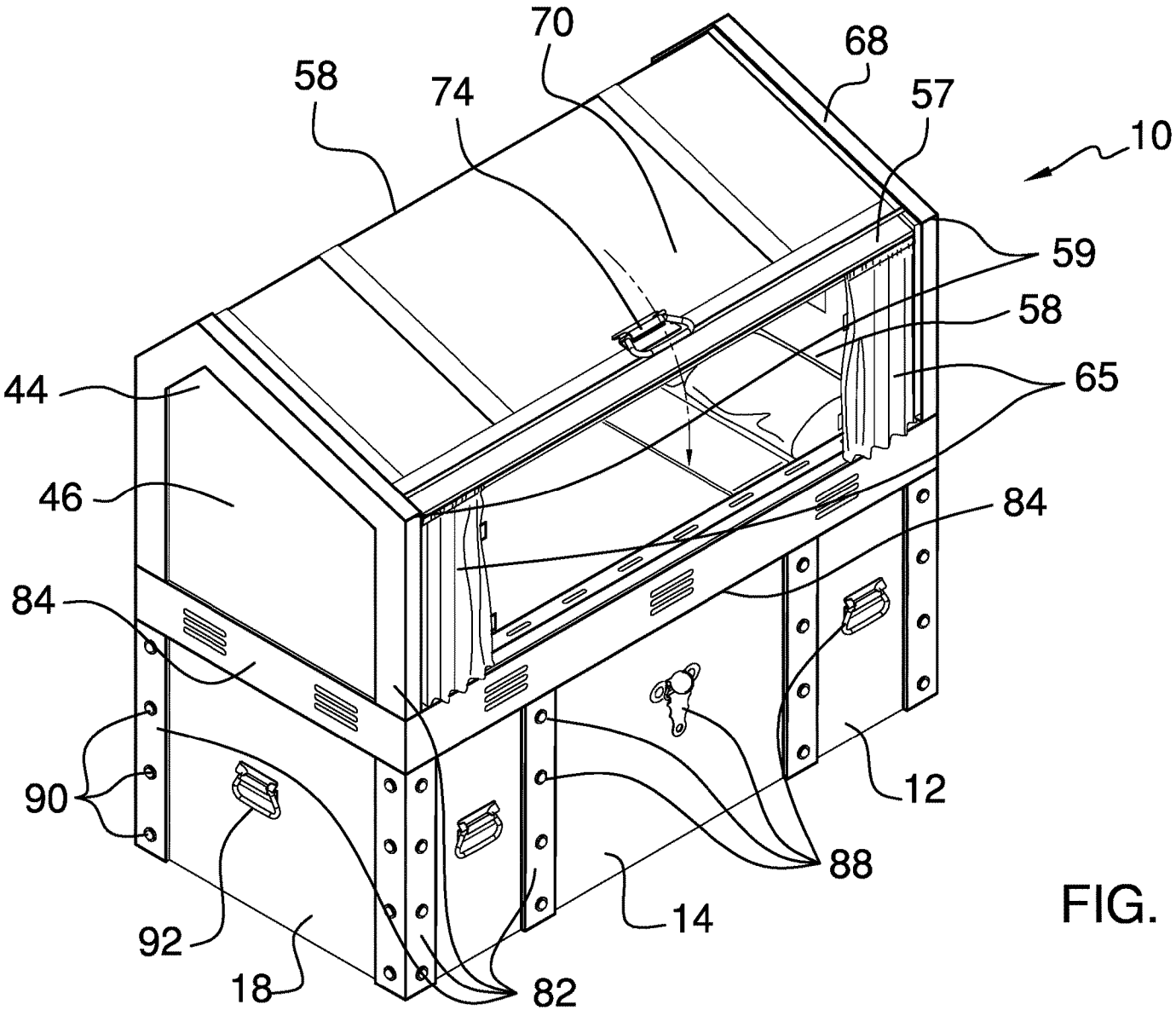
FIG. 1 is an isometric view of a treasure chest bed housing apparatus according to an embodiment of the disclosure.
Figure 2:
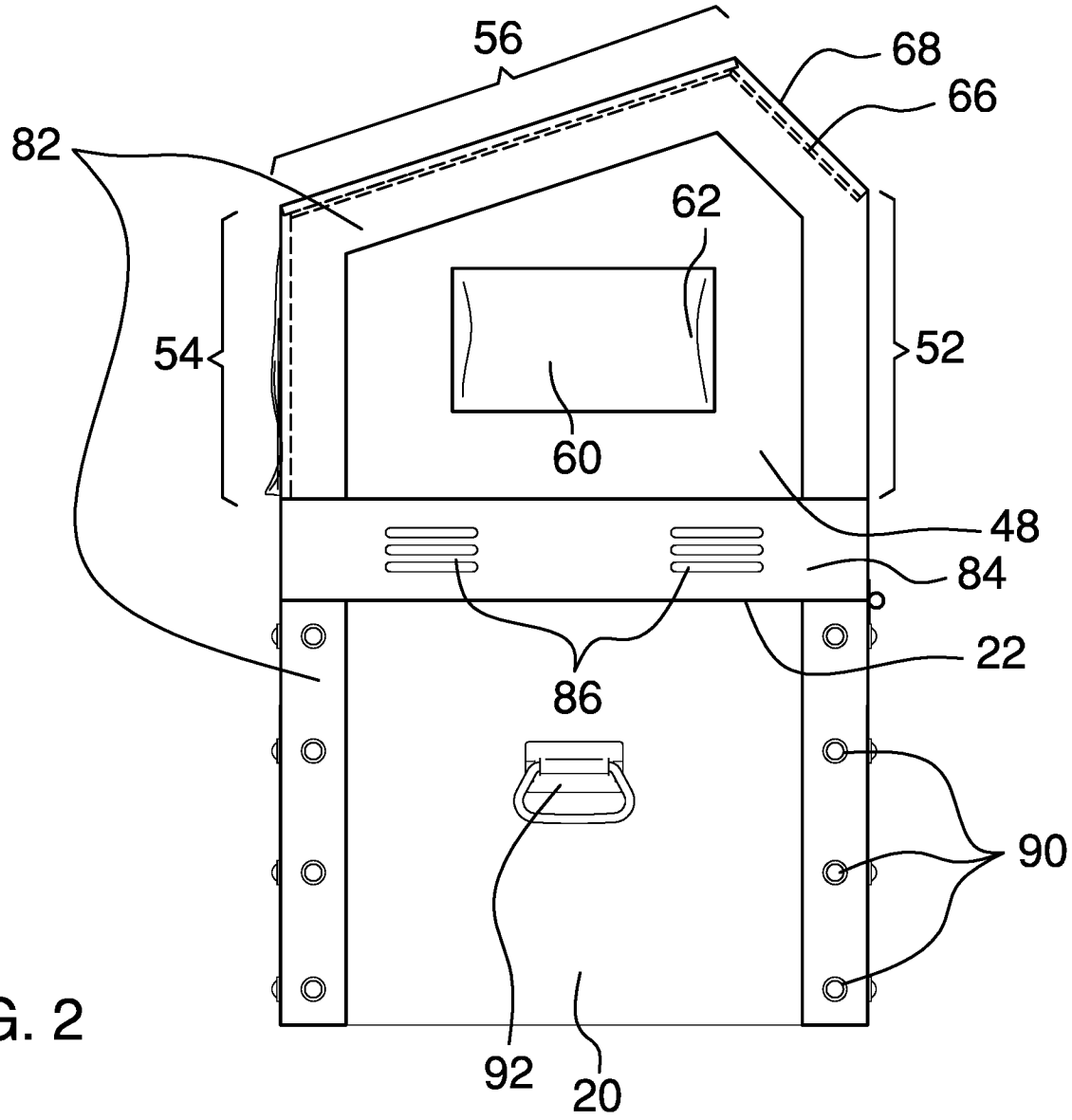
FIG. 2 is a side elevation view of an embodiment of the disclosure.
Figure 3:
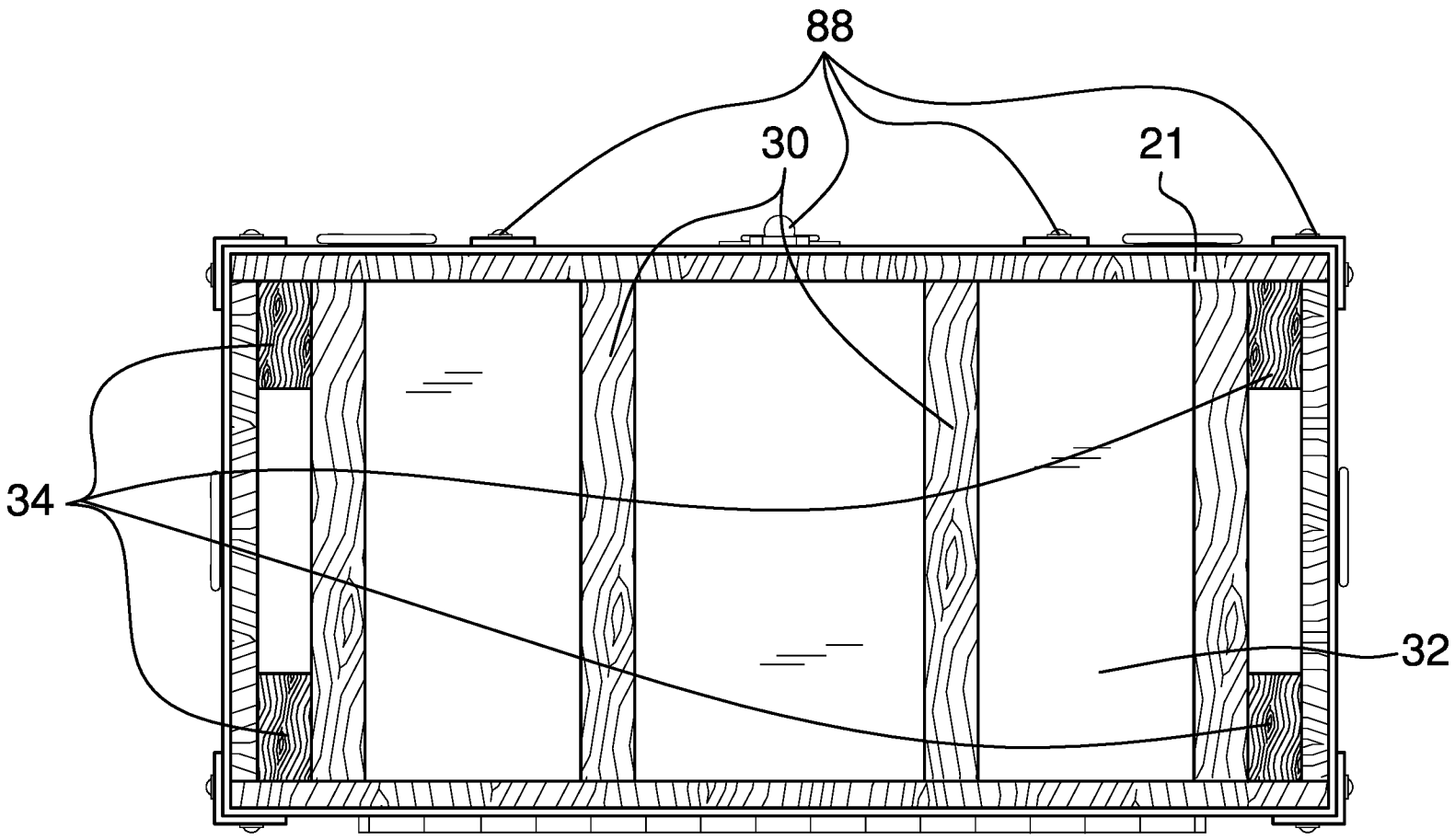
FIG. 3 is a bottom plan view of an embodiment of the disclosure.
Figure 4:
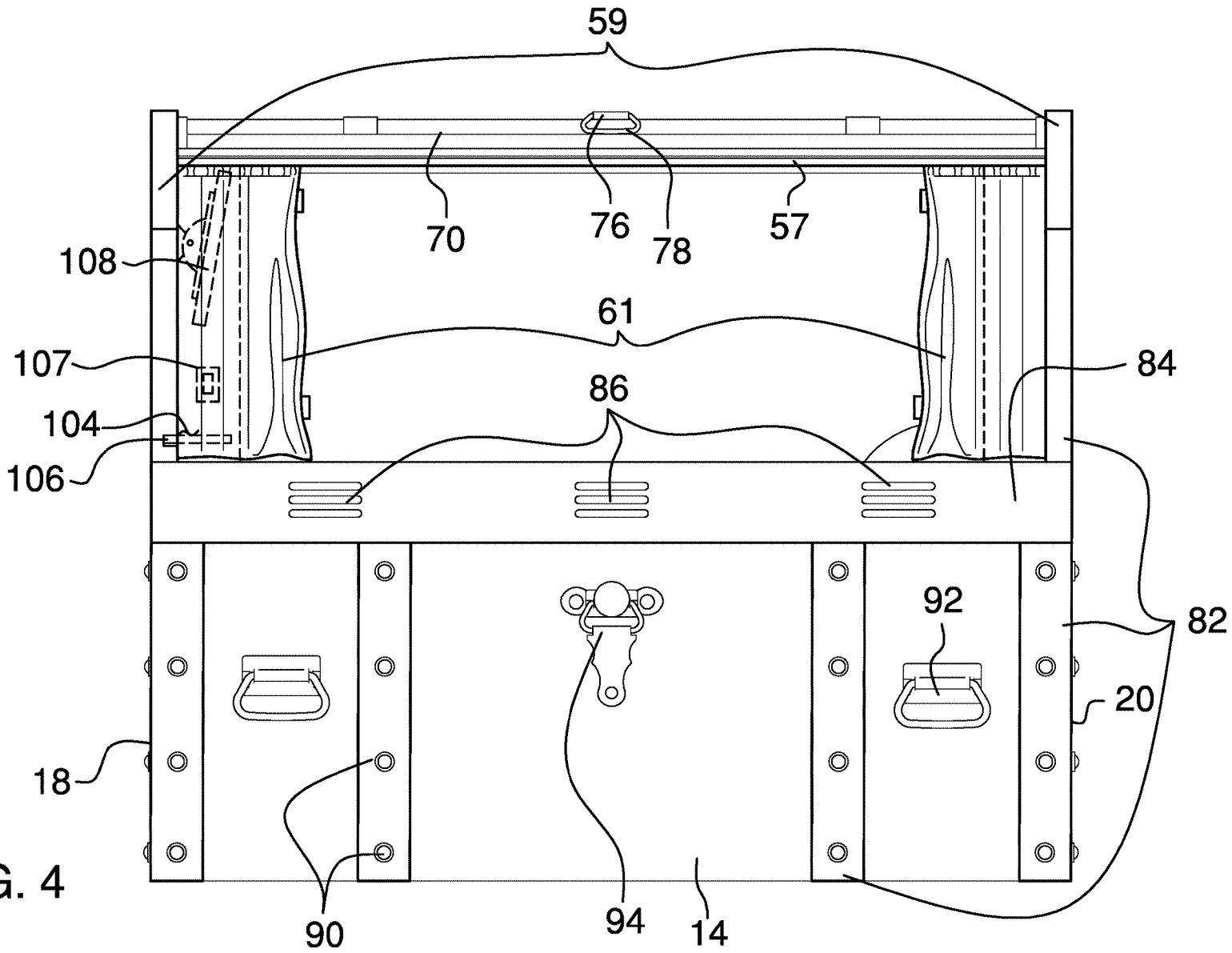
FIG. 4 is a front elevation view of an embodiment of the disclosure.
Figure 5:
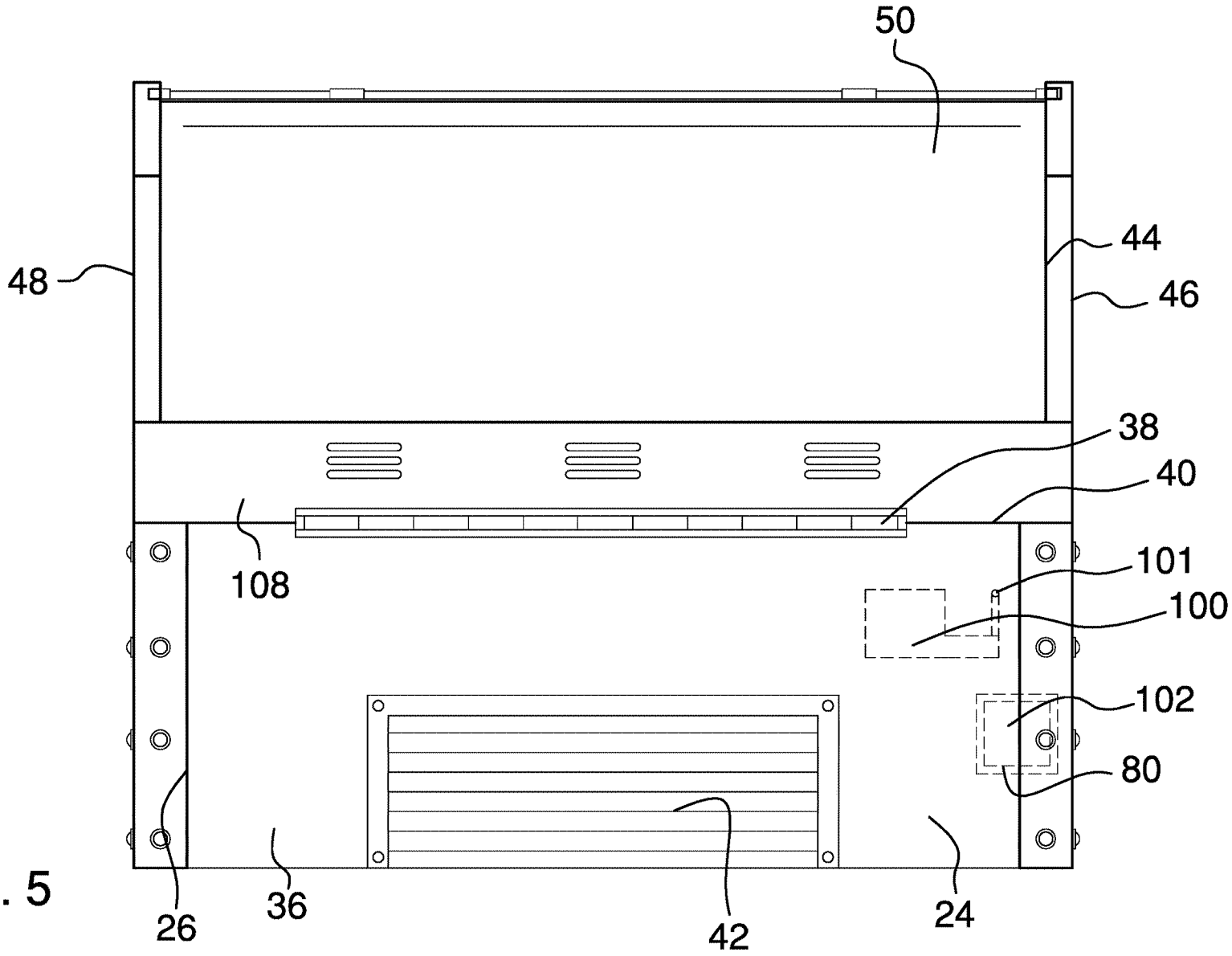
FIG. 5 is a rear view of an embodiment of the disclosure.
Figure 6:
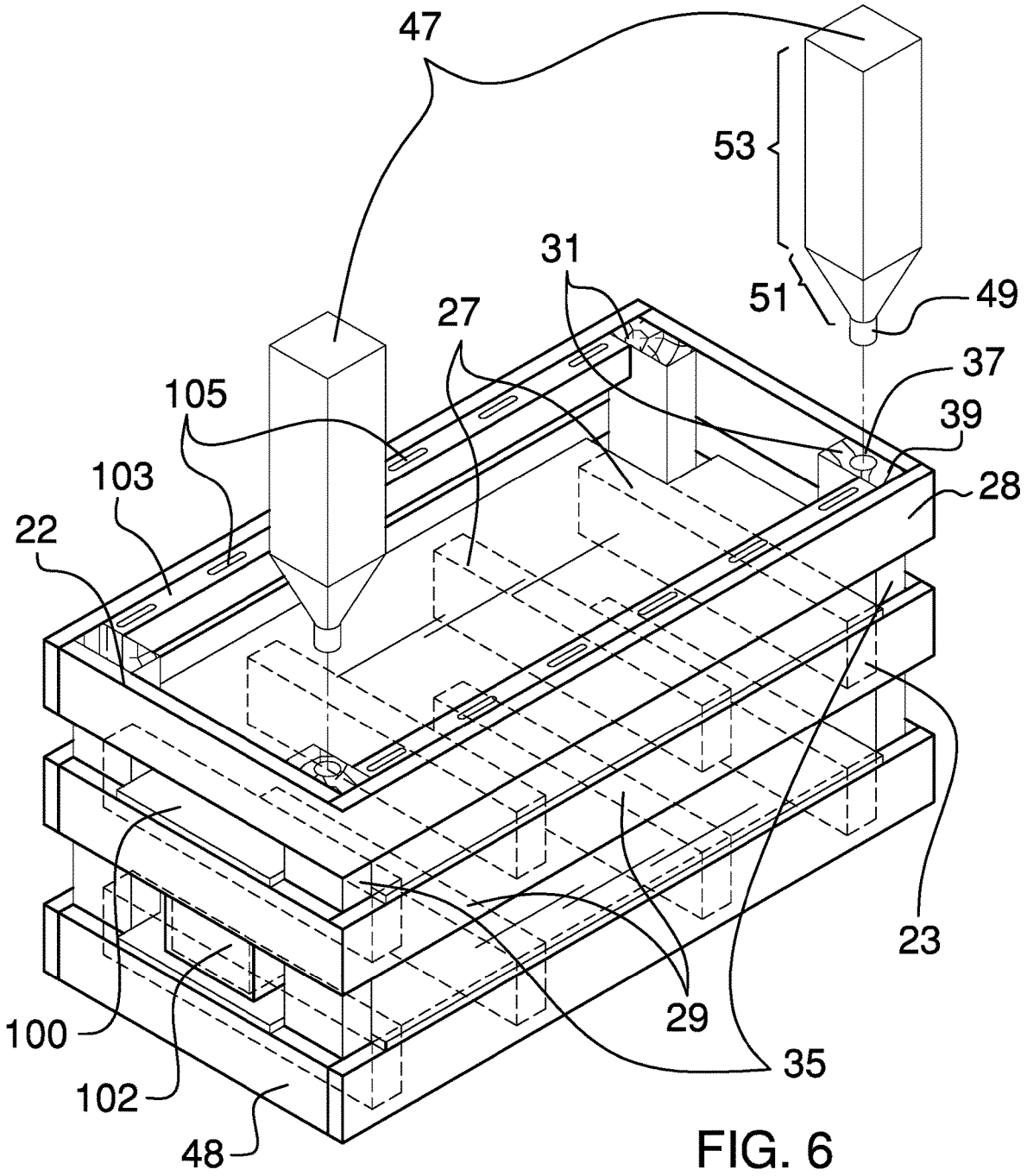
FIG. 6 is an isometric view of an embodiment of the disclosure.
Figure 7:
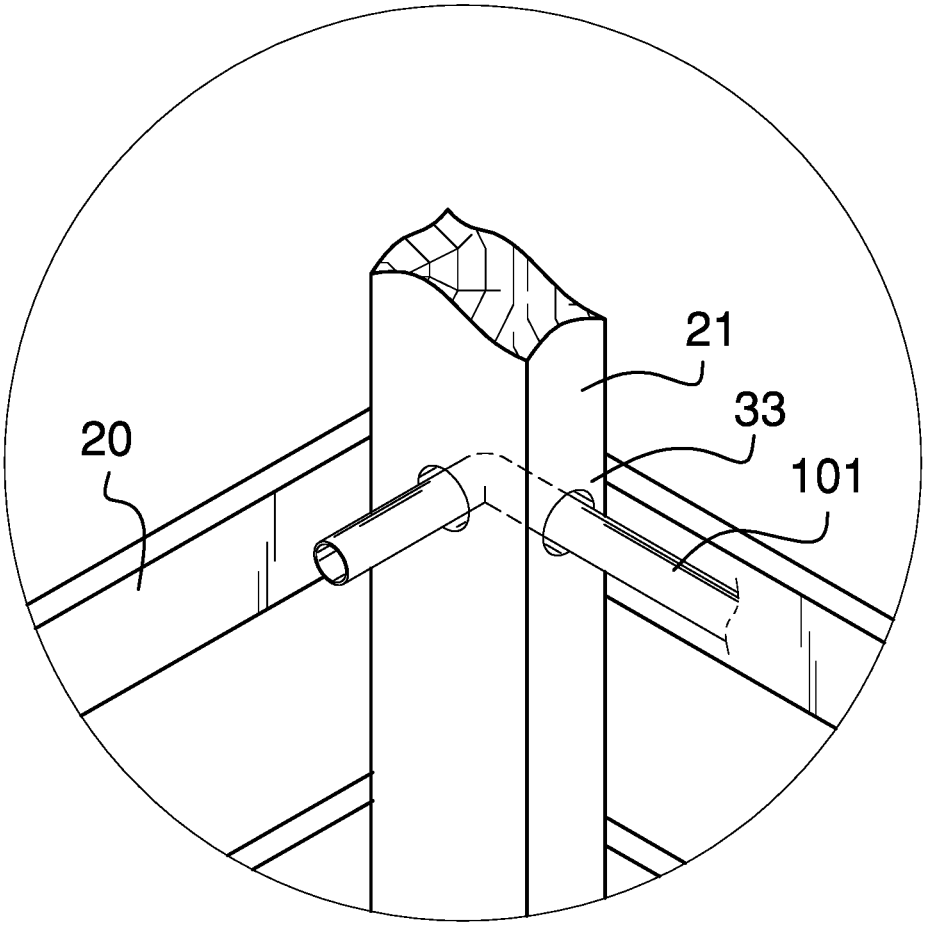
FIG. 7 is a detail view of an embodiment of the disclosure.
Figure 8:
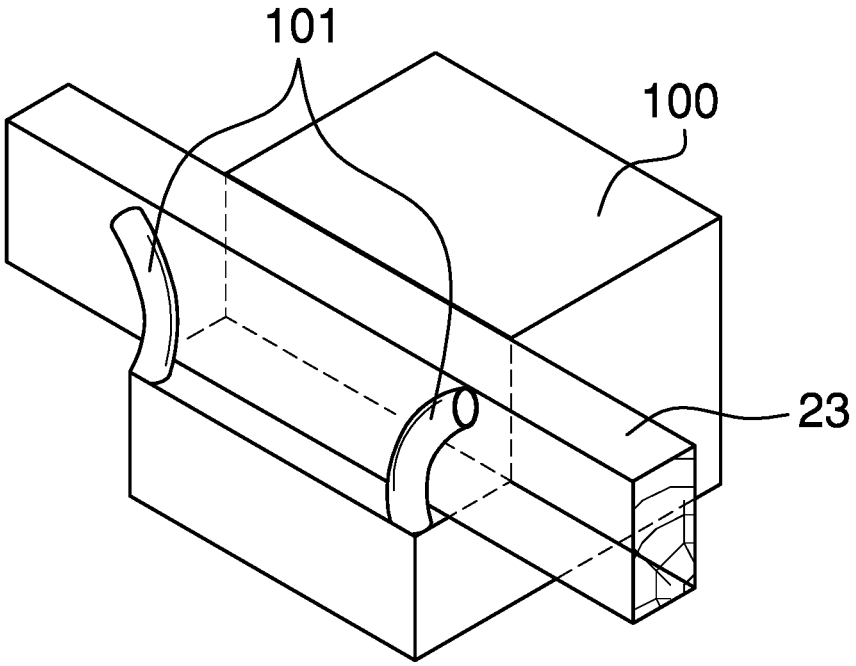
FIG. 8 is a detail view of an embodiment of the disclosure.
Figure 9:
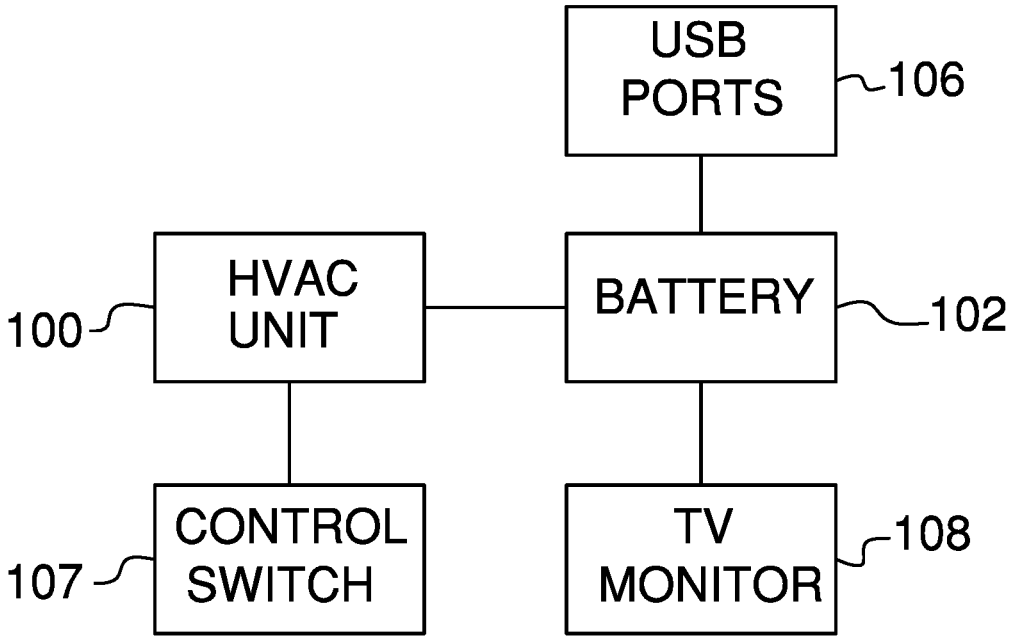
FIG. 9 is a block diagram of an embodiment of the disclosure.

With reference now to the drawings, and in particular to FIGS. 1 through 9 thereof, a new bed frame embodying the principles and concepts of an embodiment of the disclosure and generally designated by the reference numeral 10 will be described.

As best illustrated in FIGS. 1 through 9, the treasure chest bed housing apparatus 10 generally comprises a base 12 having a base front side 14 separated from a base back side 16, a base left side 18 separated from a base right side 20, and a base top side 22 defining a base interior 24. The base back side 16 has an access aperture 26 extending through to the base interior 24. The base 12 has a frame 21 comprising an outer top frame 28, a plurality of top crossmembers 30 coupled to the outer top frame 28, and a platform sheet 32 coupled on top of the outer top frame 28 and the plurality of top crossmembers 30. A plurality of support posts 34 is coupled to the corners of the outer top frame 28 for support. An outer medial frame 23 and an outer bottom frame 25 are coupled to the plurality of support posts 34. A plurality of medial crossmembers 27 is coupled to the outer medial frame 23 and a plurality of bottom crossmembers 29 is coupled to the outer bottom frame 25. A pair of foot support posts 31 of the plurality of support posts 34 adjacent the base left side 18 each have a tube aperture 33 extending therethrough. A pair of rear support posts 35 of the plurality of support posts adjacent the base back side 16 each have a receiving aperture 37 extending into a top end 39. The outer frame 28 and the top crossmembers 30 may be 2×4 lumber and the platform sheet 32 may be ¾" plywood.

An access door 36 is coupled to the base 23. The access door 36 has an access door hinge 38 along a top edge 40 coupled to the base back side 16 and the access door 36 is selectively engageable with the access aperture 26 to close and alternatively open the access aperture 26. The access door 36 has a louvered vent portion 42.

A top structure 44 is coupled to the base 12 and comprises a foot side 46, a head side 48, and a cover side 50 extending coplanarly from the base left side 18, the base right side 20, and the base back side 16, respectively. The foot side 46 and the head side 48 have a vertical back section 52, a vertical front section 54, and a pitched section 56 extending therebetween. The vertical back section 52 may be taller than the vertical front section 54. A pair of upper posts 47 each has a mounting peg 49, a tapered section 51, and a main section 53. The mounting peg 49 is selectively engageable within the receiving aperture 37 of each of the pair of rear support posts 35 to secure the pair of upper posts 47 adjacent the vertical back section 52. The base back side 50 extends through the back section 52 and the pitched section 56 and defines a top interior 58. A curtain track 57 is coupled to the top structure 44. The curtain track 57 extends across an upper end 59 of the vertical front section 54 of the foot side 46 and the head side 48. A pair of curtains 61 is coupled to the curtain track 57 and is slidable within the curtain track 57 to cover and alternatively expose the top interior 58.

An emergency flap 60 is coupled to an emergency aperture 62 of the head side 48 of the top structure. The emergency flap 60 has a pair of door hinges 64 coupled to the head side 48 to swingingly close and alternatively open the emergency aperture 62. A door track 66 is coupled to the top structure 44. The door track 66 is coupled to the foot side 46 and the head side 48 proximal an outer edge 68 and beneath the cover side 50. A principal door 70 is coupled to the door track. The principal door 70 is slidably coupled within the door track 66 to move between a closed position extending from the base 12 adjacent the front section 54 of the top structure and an alternate open position overlapping with the cover side 16 of the top structure to expose the top interior 58. A principal door handle 74 is coupled to the principal door 70 and comprises a bracket 76 and a loop 78 swingingly coupled within the bracket 76. The loop 78 may be trapezoidal.

A plurality of framing elements 82 is coupled to the base 12 and the top structure 44. The plurality of framing elements 82 is coupled to vertical edges of the base 12, a top perimeter 84 of the base, and along the outer edge 68 of the foot side 46 and the head side 48 of the top structure. The framing elements 82 coupled along the top perimeter 84 of the base extend upwards and have a plurality of vent apertures 86 extending therethrough into the top interior 58 to improve airflow within the top interior 58. The plurality of vent apertures 86 may slotted and arranged in groups of three.

A plurality of décor items 88 is coupled to the framing elements 82 and the base 12. The décor items 88 comprise a plurality of rivets 90 coupled to the framing elements 82, a plurality of decorative handles 92 coupled to the base, and a decorative latch 94 coupled to the base 12. The decorative handles 92 resemble the principal door handle 74. The base 12, the top structure 44, the principal door 70 in the closed position, and the plurality of décor items 88 resemble a treasure chest. The framing elements 82 add structural support and further the treasure chest appearance.

A bed 96 is disposed on the base top side 22 within the top interior 58. The framing elements 82 coupled along the top perimeter 84 of the base extend above the bed 96. An HVAC unit 100 is coupled to the outer medial frame 23 adjacent the base left side 18 within the base interior 24. The HVAC unit 100 has a pair of air tubes 101 extending through the tube aperture 33 of the pair of foot support posts 31 into a vent duct 103 coupled around the top perimeter 84 of the base. The vent duct 103 has a plurality of release apertures 105 to provide temperature control within the top interior 58. A battery 102 is coupled within the base interior 24 and is in operational communication with the HVAC unit 100. A control switch 107 is coupled to the top structure 44 and is in operational communication with the HVAC unit 100. A heat resistant cover 80 is coupled around the battery 102 to prevent the base interior 24 from overheating. A device shelf 104 is coupled to the foot side 46 within the top interior 58 and has a plurality of USB connectors 106 in operational communication with the battery 102. The device shelf 104 is heat resistant. A TV monitor 108 is coupled to the foot side 46 within the top interior 58 above the device shelf 104. The TV monitor 108 is in operational communication with the plurality of USB connectors 106 and the battery 102.

In use, a user enters the bed 96 and then may move the principal door 70 to the closed position. The user may exit through the emergency flap 60 if desired or required. The access door 36 is used to enter the base interior 24 to work with the battery 102 or the HVAC unit 100.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A treasure chest bed housing apparatus comprising:

a base, the base having a base front side separated from a base back side, a base left side separated from a base right side, and a base top side defining a base interior, the base back side having an access aperture extending through to the base interior;

an access door coupled to the base, the access door being selectively engageable with the access aperture to close and alternatively open the access aperture;

a top structure coupled to the base, the top structure comprising a foot side, a head side, and a cover side extending coplanarly from the base left side, the base right side, and the base back side, respectively, the foot side and the head side having a vertical back section, a vertical front section, and a pitched section extending therebetween, the base back side extending through the back section and the pitched section and defining a top interior;

a door track coupled to the top structure, the door track being coupled to the foot side and the head side proximal an outer edge and beneath the cover side;

a principal door coupled to the door track, the principal door being slidably coupled within the door track to move between a closed position extending from the base adjacent the front section of the top structure and an alternate open position overlapping with the cover side of the top structure;

wherein the base, the top structure, and the principal door in the closed position resemble a treasure chest;

a bed coupled to the base, the bed being disposed on the base top side within the top interior;

an HVAC unit coupled to the base, the HVAC unit being coupled within the base interior;

a control switch coupled to the top structure, the control switch being in operational communication with the HVAC unit; and a battery coupled to the base, the battery being coupled within the base interior and in operational communication with the HVAC unit.

2. The treasure chest bed housing apparatus of claim 1 further comprising a plurality of framing elements coupled to the base and the top structure, the plurality of framing elements being coupled to vertical edges of the base, a top perimeter of the base, and along the outer edge of the foot side and the head side of the top structure, the framing elements coupled along the top perimeter of the base extending above the bed and having a plurality of vent apertures extending therethrough into the top interior.

3. The treasure chest bed housing apparatus of claim 1 further comprising an emergency flap coupled to an emergency aperture of the head side of the top structure, the emergency flap having a pair of door hinges coupled to the head side to swingingly close and alternatively open the emergency aperture.

4. The treasure chest bed housing apparatus of claim 1 further comprising the vertical back section being taller than the vertical front section.

5. The treasure chest bed housing apparatus of claim 1 further comprising a principal door handle coupled to the principal door, the principal door handle comprising a bracket and a loop swingingly coupled within the bracket.

6. The treasure chest bed housing apparatus of claim 2 further comprising a plurality of décor items coupled to the framing elements and the base, the décor items comprising a plurality of rivets coupled to the framing elements, a plurality of decorative handles coupled to the base, and a decorative latch coupled to the base.

7. The treasure chest bed housing apparatus of claim 1 further comprising a device shelf coupled to the top structure, the device shelf being coupled to the foot side within the top interior, the device shelf having a plurality of USB connectors in operational communication with the battery.

8. The treasure chest bed housing apparatus of claim 7 further comprising a TV monitor coupled to the top structure, the TV monitor being coupled to the foot side within the top interior above the device shelf, the TV monitor being in operational communication with the plurality of USB connectors and the battery.

9. The treasure chest bed housing apparatus of claim 8 further comprising the device shelf being heat resistant and a heat resistant cover coupled around the battery.

10. The treasure chest bed housing apparatus of claim 1 further comprising the access door having an access door hinge along a top edge coupled to the base back side, the access door having a louvered vent portion.

11. The treasure chest bed housing apparatus of claim 1 further comprising the base having an inner frame comprising an outer top frame, a plurality of top crossmembers coupled to the outer top frame, and a platform sheet coupled on top of the outer top frame and the plurality of top crossmembers.

12. The treasure chest bed housing apparatus of claim 11 further comprising a plurality of support posts coupled to the corners of the outer top frame, an outer medial frame coupled to the plurality of support posts, a plurality of medial crossmembers coupled to the outer medial frame, an outer bottom frame coupled to the plurality of support posts, and a plurality of bottom crossmembers coupled to the outer bottom frame.

13. The treasure chest bed housing apparatus of claim 12 further comprising a pair of rear support posts of the plurality of support posts adjacent the base back side having a receiving aperture extending into a top end, a pair of upper posts having a mounting peg, a tapered section, and a main section, the mounting peg selectively engageable within the receiving aperture of each of the pair of rear support posts.

14. The treasure chest bed housing apparatus of claim 12 further comprising the HVAC unit being coupled to the outer medial frame adjacent the base left side, a pair of foot support posts of the plurality of support posts adjacent the base left side each having a tube aperture extending therethrough, the HVAC unit having a pair of air tubes extending through the tube aperture of the pair of foot support posts into a vent duct coupled around the top perimeter of the base, the vent duct having a plurality of release apertures.

15. The treasure chest bed housing apparatus of claim 1 further comprising a pair of curtains coupled to a curtain track extending across an upper end of the vertical front section of the foot side and the head side.

16. A treasure chest bed housing apparatus comprising:

a base, the base having a base front side separated from a base back side, a base left side separated from a base right side, and a base top side defining a base interior, the base back side having an access aperture extending through to the base interior, the base having an inner frame comprising an outer top frame, a plurality of top crossmembers coupled to the outer top frame, and a platform sheet coupled on top of the outer top frame and the plurality of top crossmembers, a plurality of support posts coupled to the corners of the outer top frame, an outer medial frame coupled to the plurality of support posts, a plurality of medial crossmembers coupled to the outer medial frame, an outer bottom frame coupled to the plurality of support posts, and a plurality of bottom crossmembers coupled to the outer bottom frame, a pair of foot support posts of the plurality of support posts adjacent the base left side each having a tube aperture extending therethrough, a pair of rear support posts of the plurality of support posts adjacent the base back side having a receiving aperture extending into a top end;

an access door coupled to the base, the access door having an access door hinge along a top edge coupled to the base back side and being selectively engageable with the access aperture to close and alternatively open the access aperture, the access door having a louvered vent portion;

a top structure coupled to the base, the top structure comprising a foot side, a head side, and a cover side extending coplanarly from the base left side, the base right side, and the base back side, respectively, the foot side and the head side having a vertical back section, a vertical front section, and a pitched section extending therebetween, the vertical back section being taller than the vertical front section, the base back side extending through the back section and the pitched section and defining a top interior;

a pair of upper posts coupled to the base, the pair of upper posts each having a mounting peg, a tapered section, and a main section, the mounting peg selectively engageable within the receiving aperture of each of the pair of rear support posts;

a curtain track coupled to the top structure, the curtain track extending across an upper end of the vertical front section of the foot side and the head side;

a pair of curtains coupled to the curtain track, the pair of curtains being slidable within the curtain track to cover and alternatively expose the top interior;

an emergency flap coupled to an emergency aperture of the head side of the top structure, the emergency flap having a pair of door hinges coupled to the head side to swingingly close and alternatively open the emergency aperture;

a door track coupled to the top structure, the door track being coupled to the foot side and the head side proximal an outer edge and beneath the cover side;

a principal door coupled to the door track, the principal door being slidably coupled within the door track to move between a closed position extending from the base adjacent the front section of the top structure and an alternate open position overlapping with the cover side of the top structure;

a principal door handle coupled to the principal door, the principal door handle comprising a bracket and a loop swingingly coupled within the bracket;

a bed coupled to the base, the bed being disposed on the base top side within the top interior;

a plurality of framing elements coupled to the base and the top structure, the plurality of framing elements being coupled to vertical edges of the base, a top perimeter of the base, and along the outer edge of the foot side and the head side of the top structure, the framing elements coupled along the top perimeter of the base extending above the bed and having a plurality of vent apertures extending therethrough into the top interior;

a plurality of décor items coupled to the framing elements and the base, the décor items comprising a plurality of rivets coupled to the framing elements, a plurality of decorative handles coupled to the base, and a decorative latch coupled to the base;

wherein the base, the top structure, the principal door in the closed position, and the plurality of décor items resemble a treasure chest;

a vent duct coupled to the base, the vent duct being coupled around the top perimeter of the base and having a plurality of release apertures;

an HVAC unit coupled to the base, the HVAC unit being coupled to the outer medial frame adjacent the base left side within the base interior, the HVAC unit having a pair of air tubes extending through the tube aperture of the pair of foot support posts;

a control switch coupled to the top structure, the control switch being in operational communication with the HVAC unit;

a battery coupled to the base, the battery being coupled within the base interior and in operational communication with the HVAC unit;

a heat resistant panel coupled to the battery, the heat resistant cover being coupled around the battery within the base interior;

a device shelf coupled to the top structure, the device shelf being coupled to the foot side within the top interior, the device shelf having a plurality of USB connectors in operational communication with the battery, the device shelf being heat resistant; and a TV monitor coupled to the top structure, the TV monitor being coupled to the foot side within the top interior above the device shelf, the TV monitor being in operational communication with the plurality of USB connectors and the battery.

* * * * *